US009874112B2

(12) United States Patent
Giegel

(10) Patent No.: US 9,874,112 B2
(45) Date of Patent: Jan. 23, 2018

(54) HEAT ENGINE SYSTEM HAVING A SELECTIVELY CONFIGURABLE WORKING FLUID CIRCUIT

(71) Applicant: Josua Giegel, Streetsboro, OH (US)

(72) Inventor: Josua Giegel, Streetsboro, OH (US)

(73) Assignee: Echogen Power Systems, LLC, Akron, OH (US)

( * ) Notice: Subject to any disclaimer, the term of this patent is extended or adjusted under 35 U.S.C. 154(b) by 676 days.

(21) Appl. No.: 14/475,640

(22) Filed: Sep. 3, 2014

(65) Prior Publication Data

US 2015/0076831 A1 Mar. 19, 2015

Related U.S. Application Data

(60) Provisional application No. 61/874,321, filed on Sep. 5, 2013, provisional application No. 62/010,731, filed on Jun. 11, 2014, provisional application No. 62/010,706, filed on Jun. 11, 2014.

(51) Int. Cl.

| | |
|---|---|
| ***F01K 25/08*** | (2006.01) |
| ***F01K 7/40*** | (2006.01) |
| ***F22D 1/32*** | (2006.01) |
| ***F01K 9/02*** | (2006.01) |
| ***F01K 23/12*** | (2006.01) |
| *F01K 25/10* | (2006.01) |

(52) U.S. Cl.

CPC ..... *F01K 7/40* (2013.01); *F01K 9/02* (2013.01); *F01K 23/12* (2013.01); *F01K 25/08* (2013.01); *F22D 1/32* (2013.01); *F01K 25/10* (2013.01)

(58) Field of Classification Search

CPC ..... F01K 25/08; H01K 25/08; F22D 1/32

See application file for complete search history.

(56) References Cited

U.S. PATENT DOCUMENTS

| | | | | |
|---|---|---|---|---|
| 5,526,646 | A * | 6/1996 | Bronicki | F01D 15/10 165/45 |
| 5,588,297 | A * | 12/1996 | Uehara | F01K 25/065 60/649 |
| 7,665,304 | B2 * | 2/2010 | Sundel | 60/671 |
| 8,695,347 | B2 * | 4/2014 | Hatamiya | F01K 7/38 60/652 |
| 2005/0183421 | A1 * | 8/2005 | Vaynberg | F01K 25/08 60/641.8 |
| 2007/0101732 | A1 * | 5/2007 | Mak | 62/50.3 |

(Continued)

*Primary Examiner* — Mark Laurenzi
*Assistant Examiner* — Shafiq Mian

(57) ABSTRACT

Heat engine systems having selectively configurable working fluid circuits are provided. One heat engine system includes a pump that circulates a working fluid through a working fluid circuit and an expander that receives the working fluid from a high pressure side of the working fluid circuit and converts a pressure drop in the working fluid to mechanical energy. A plurality of waste heat exchangers are each selectively positioned in or isolated from the high pressure side. A plurality of recuperators are each selectively positioned in or isolated from the high pressure side and the low pressure side. A plurality of valves are actuated to enable selective control over which of the plurality of waste heat exchangers is positioned in the high pressure side, which of the plurality of recuperators is positioned in the high pressure side, and which of the plurality of recuperators is positioned in the low pressure side.

17 Claims, 7 Drawing Sheets

(56) References Cited

U.S. PATENT DOCUMENTS

| | | | | |
|---|---|---|---|---|
| 2010/0205966 | A1* | 8/2010 | Matteson et al. | 60/646 |
| 2010/0319346 | A1* | 12/2010 | Ast | F01K 23/04 60/616 |
| 2010/0326076 | A1* | 12/2010 | Ast | F01K 23/04 60/671 |
| 2011/0041502 | A1* | 2/2011 | Zimron | F01K 23/04 60/641.15 |
| 2011/0072818 | A1* | 3/2011 | Cook | F01K 13/02 60/645 |
| 2011/0088397 | A1* | 4/2011 | Mori et al. | 60/661 |
| 2012/0000201 | A1* | 1/2012 | Ast | F01K 3/004 60/652 |
| 2012/0047892 | A1* | 3/2012 | Held et al. | 60/652 |
| 2012/0319410 | A1* | 12/2012 | Ambrosek | F02C 1/05 290/1 R |
| 2014/0102098 | A1* | 4/2014 | Bowan | F01K 7/32 60/645 |
| 2014/0102101 | A1* | 4/2014 | Xie | F01K 7/32 60/647 |
| 2014/0208750 | A1* | 7/2014 | Vermeersch | F01K 13/02 60/646 |

* cited by examiner

HEAT ENGINE SYSTEM HAVING A SELECTIVELY CONFIGURABLE WORKING FLUID CIRCUIT

CROSS-REFERENCE TO RELATED APPLICATIONS

This application claims the benefit of U.S. Prov. Appl. No. 61/874,321, entitled "Highly Efficient Heat Engine System with a Supercritical Carbon Dioxide Circuit" and filed Sep. 5, 2013; U.S. Prov. Appl. No. 62/010,731, entitled "Control Methods for Heat Engine Systems Having a Selectively Configurable Working Fluid Circuit" and filed Jun. 11, 2014; and U.S. Prov. Appl. No. 62/010,706, entitled "Heat Engine System Having a Selectively Configurable Working Fluid Circuit" and filed Jun. 11, 2014. These applications are incorporated herein by reference in their entirety to the extent consistent with the present application.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Therefore, waste heat may be converted into useful energy by a variety of turbine generator or heat engine systems that employ thermodynamic methods, such as Rankine cycles or other power cycles. Rankine and similar thermodynamic cycles are typically steam-based processes that recover and utilize waste heat to generate steam for driving a turbine, turbo, or other expander connected to an electric generator, a pump, or other device.

An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbons, such as hydrochlorofluorocarbons (HCFCs) or hydrofluorocarbons (HFCs) (e.g., R245fa). More recently, in view of issues such as thermal instability, toxicity, flammability, and production cost of the lower boiling-point working fluids, some thermodynamic cycles have been modified to circulate non-hydrocarbon working fluids, such as ammonia.

One of the primary factors that affects the overall system efficiency when operating a power cycle or another thermodynamic cycle is being efficient at the heat addition step. Poorly designed heat engine systems and cycles can be inefficient at heat to electrical power conversion in addition to requiring large heat exchangers to perform the task. Such systems deliver power at a much higher cost per kilowatt than highly optimized systems. Heat exchangers that are capable of handling such high pressures and temperatures generally account for a large portion of the total cost of the heat engine system.

Therefore, there is a need for heat engine systems and methods for transforming energy, whereby the systems and methods provide improved efficiency while generating work or electricity from thermal energy.

SUMMARY

In one embodiment, a heat engine system includes a working fluid circuit having a high pressure side and a low pressure side and being configured to flow a working fluid therethrough. Each of a plurality of waste heat exchangers is configured to be fluidly coupled to and in thermal communication with the high pressure side of the working fluid circuit, to be fluidly coupled to and in thermal communication with a heat source stream, and to transfer thermal energy from the heat source stream to the working fluid within the high pressure side. Each of a plurality of recuperators is fluidly coupled to the working fluid circuit and configured to transfer thermal energy between the high pressure side and the low pressure side of the working fluid circuit. A first expander is fluidly coupled to the working fluid circuit and disposed between the high pressure side and the low pressure side and configured to convert a pressure drop in the working fluid to mechanical energy. A second expander is fluidly coupled to the working fluid circuit, disposed between the high pressure side and the low pressure side, and configured to convert a pressure drop in the working fluid to mechanical energy. A first pump is fluidly coupled to the working fluid circuit between the low pressure side and the high pressure side of the working fluid circuit and configured to circulate or pressurize the working fluid within the working fluid circuit. A first condenser is in thermal communication with the working fluid on the low pressure side of the working fluid circuit and configured to remove thermal energy from the working fluid on the low pressure side of the working fluid circuit.

In another embodiment, a heat engine system includes a pump configured to pressurize and circulate a working fluid through a working fluid circuit having a high pressure side and a low pressure side. A first expander is configured to receive the working fluid from the high pressure side and to convert a pressure drop in the working fluid to mechanical energy. A plurality of waste heat exchangers are disposed in series along a flow path of a heat source stream and configured to transfer thermal energy from the heat source stream to the working fluid and to be selectively positioned in or isolated from the high pressure side. Each of a plurality of recuperators is configured to transfer thermal energy from the working fluid flowing through the low pressure side to the working fluid flowing through the high pressure side and to be selectively positioned in or isolated from the high pressure side and the low pressure side. A plurality of valves is configured to be actuated to enable selective control over which of the plurality of waste heat exchangers is positioned in the high pressure side, which of the plurality of recuperators is positioned in the high pressure side, and which of the plurality of recuperators is positioned in the low pressure side In another embodiment, a heat engine system includes a working fluid circuit having a high pressure side and a low pressure side and being configured to flow a working fluid therethrough. A first expander is configured to receive the working fluid from the high pressure side and to convert a pressure drop in the working fluid to mechanical energy. A second expander is configured to receive the working fluid from the high pressure side and to convert the pressure drop in the working fluid to mechanical energy. A plurality of waste heat exchangers is disposed in series along a flow path of a heat source stream and configured to transfer thermal energy from the heat source stream to the working fluid and to be selectively positioned in or isolated from the high pressure side. Each of a plurality of recuperators is configured to transfer thermal energy from the working fluid flowing through the low pressure side to the working fluid flowing through the high pressure side and to be selectively positioned in or isolated from the high pressure side and the low pressure side. Each of a plurality of valves is configured to be actuated to enable selective control over which of the plurality of waste heat exchangers is positioned in the high pressure side, which of the plurality of recuperators is positioned in the high pressure side, which of the plurality of recuperators is positioned in the low pressure side, and which of the first expander and the second expander is to receive the working fluid from the high pressure side.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Presently disclosed embodiments generally provide heat engine systems and methods for transforming energy, such as generating mechanical energy and/or electrical energy from thermal energy. More particularly, the disclosed embodiments provide heat engine systems that are enabled for selective configuring of a working fluid circuit in one of several different configurations, depending on implementation-specific considerations. For example, in certain embodiments, the configuration of the working fluid circuit may be determined based on the heat source providing the thermal energy to the working fluid circuit. More particularly, in one embodiment, the heat engine system may include a plurality of valves that enable the working fluid to be selectively routed through one or more waste heat exchangers and one or more recuperators to tune the heat engine system to the available heat source, thus increasing the efficiency of the heat engine system in the conversion of the thermal energy into a useful power output. These and other features of the selectively configurable working fluid circuits are discussed in more detail below.

The heat engine systems including the selectively configurable working fluid circuits, as described herein, are configured to efficiently convert thermal energy of a heated stream (e.g., a waste heat stream) into useful mechanical energy and/or electrical energy. To that end, in some embodiments, the heat engine systems may utilize the working fluid (e.g., carbon dioxide ($CO_2$)) in a supercritical state (e.g., sc-$CO_2$) and/or a subcritical state (e.g., sub-$CO_2$) within the working fluid circuit for capturing or otherwise absorbing thermal energy of the waste heat stream with one or more waste heat exchangers. The thermal energy may be transformed to mechanical energy by a power turbine and subsequently transformed to electrical energy by a power generator coupled to the power turbine. Further, the heat engine systems may include several integrated sub-systems managed by a process control system for maximizing the efficiency of the heat engine system while generating mechanical energy and/or electrical energy.

Figure 1:
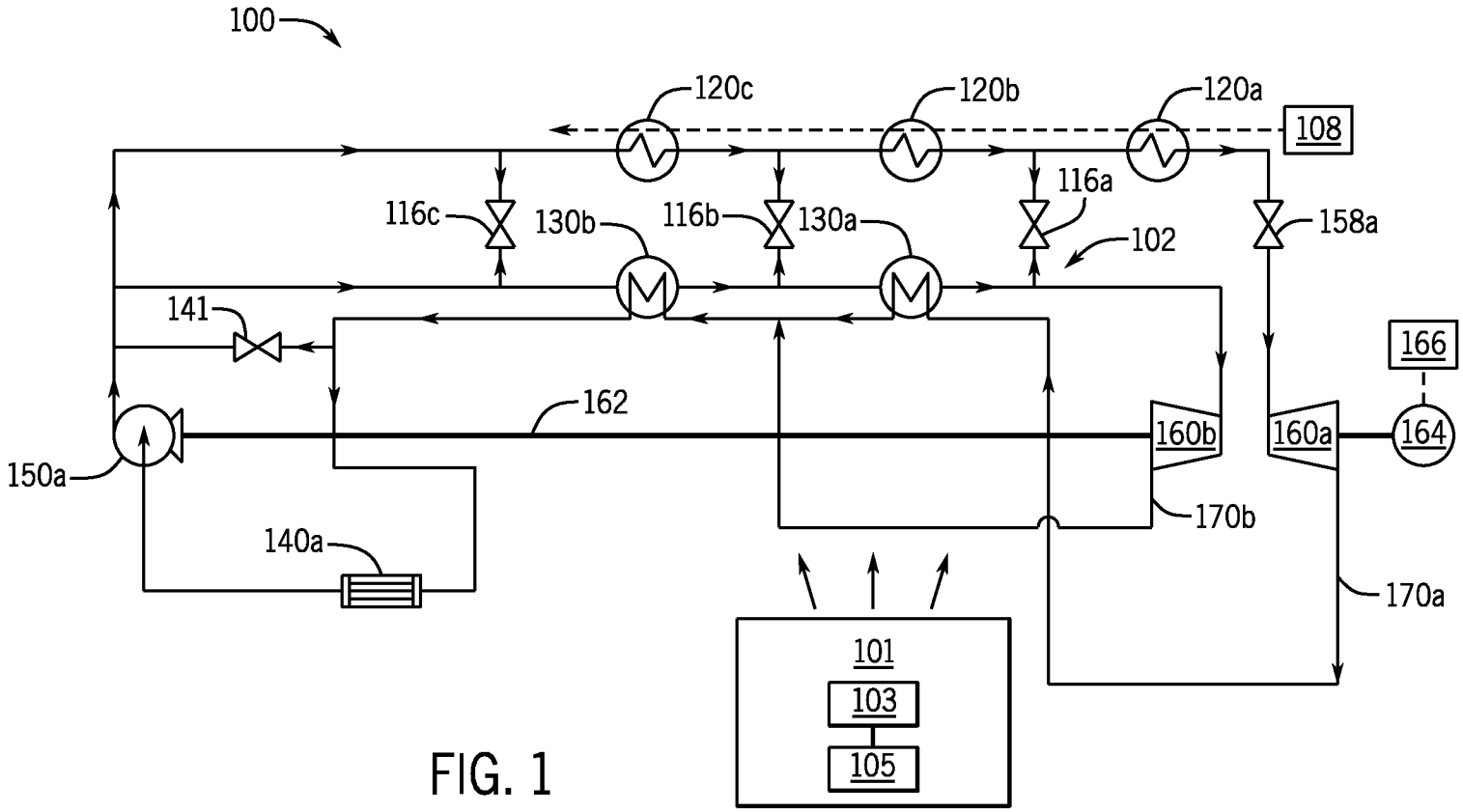
FIG. 1 illustrates a heat engine system having a selectively configurable working fluid circuit, according to one or more embodiments disclosed herein.

Turning now to the drawings, FIG. 1 illustrates an embodiment of a heat engine system 100 having a working fluid circuit 102 that may be selectively configured by a control system 101 such that a flow path of a working fluid is established through any desired combination of a plurality of waste heat exchangers 120*a*, 120*b*, and 120*c*, a plurality of recuperators 130*a*, and 130*b*, turbines or expanders 160*a* and 160*b*, a pump 150*a*, and a condenser 140*a*. To that end, a plurality of bypass valves 116*a*, 116*b*, and 116*c* are provided that each may be selectively positioned in an opened position or a closed position to enable the routing of the working fluid through the desired components.

The working fluid circuit 102 generally has a high pressure side and a low pressure side and is configured to flow the working fluid through the high pressure side and the low pressure side. In the embodiment of FIG. 1, the high pressure side extends along the flow path of the working fluid from the pump 150*a* to the expander 160*a* and/or the expander 160*b*, depending on which of the expanders 160*a* and 160*b* are included in the working fluid circuit 102, and the low pressure side extends along the flow path of the working fluid from the expander 160*a* and/or the expander 160*b* to the pump 150*a*. In some embodiments, working fluid may be transferred from the low pressure side to the high pressure side via a pump bypass valve 141.

Depending on the features of the given implementation, the working fluid circuit 102 may be configured such that the available components (e.g., the waste heat exchangers 120*a*, 120*b*, and 120*c* and the recuperators 130*a* and 130*b*) are each selectively positioned in (e.g., fluidly coupled to) or isolated from (e.g., not fluidly coupled to) the high pressure side and the low pressure side of the working fluid circuit. For example, in one embodiment, the control system 101 may utilize the processor 103 to determine which of the waste heat exchangers 120*a*, 120*b*, and 120*c* and which of the recuperators 130*a* and 130*b* to position on (e.g., incorporate in) the high pressure side of the working fluid circuit 102. Such a determination may be made by the processor 103, for example, by referencing memory 105 to determine how to tune the heat engine system 100 to operate most efficiently with a given heat source.

For further example, in one embodiment, a turbopump may be formed by a driveshaft 162 coupling the second expander 160*b* and the pump 150*a*, such that the second expander 160*b* may drive the pump 150*a* with the mechanical energy generated by the second expander 160*b*. In this embodiment, the working fluid flow path from the pump 150*a* to the second expander 160*b* may be established by selectively fluidly coupling the recuperator 130*b* and the waste heat exchanger 120*b* to the high pressure side by positioning valves the bypass 116*a* and 116*b* in an opened position. The working fluid flow path in this embodiment extends from the pump 150*a*, through the recuperator 130*b*, through the bypass valve 116*b*, through the waste heat exchanger 120*b*, through the bypass valve 116*a*, and to the second expander 160*b*. The working fluid flow path through the low pressure side in this embodiment extends from the second expander 160*b* through turbine discharge line 170*b*, through the recuperator 130*b*, through the condenser 140*a*, and to the pump 150*a*.

Still further, in another embodiment, the working fluid flow path may be established from the pump 150*a* to the first expander 160*a* by fluidly coupling the waste heat exchanger 120*c*, the recuperator 130*a*, and the waste heat exchanger 120*a* to the high pressure side. In such an embodiment, the working fluid flow path through the high pressure side extends from the pump 150*a*, through the waste heat exchanger 120*c*, through the bypass valve 116*b*, through the recuperator 130*a*, through the bypass valve 116*a*, through the waste heat exchanger 120*a*, through the stop or throttle valve 158*a*, and to the first expander 160*a*. The working fluid flow path through the low pressure side in this embodiment extends from the first expander 160*a*, through turbine discharge line 170*a*, through the recuperator 130*a*, through the recuperator 130*b*, through the condenser 140*a*, and to the pump 150*a*.

Figure 2:
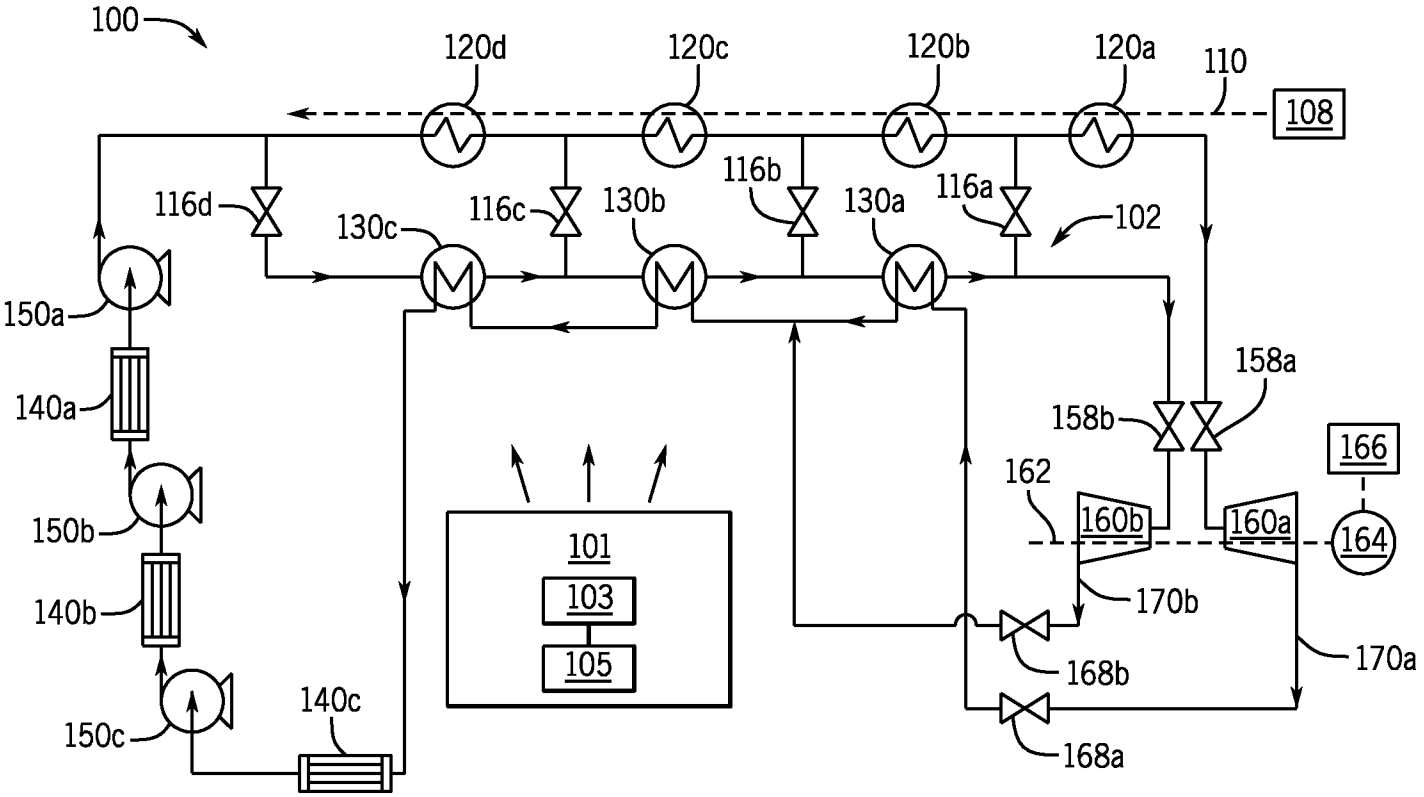
FIG. 2 illustrates another heat engine system having a selectively configurable working fluid circuit, according to one or more embodiments disclosed herein.
Figure 3:
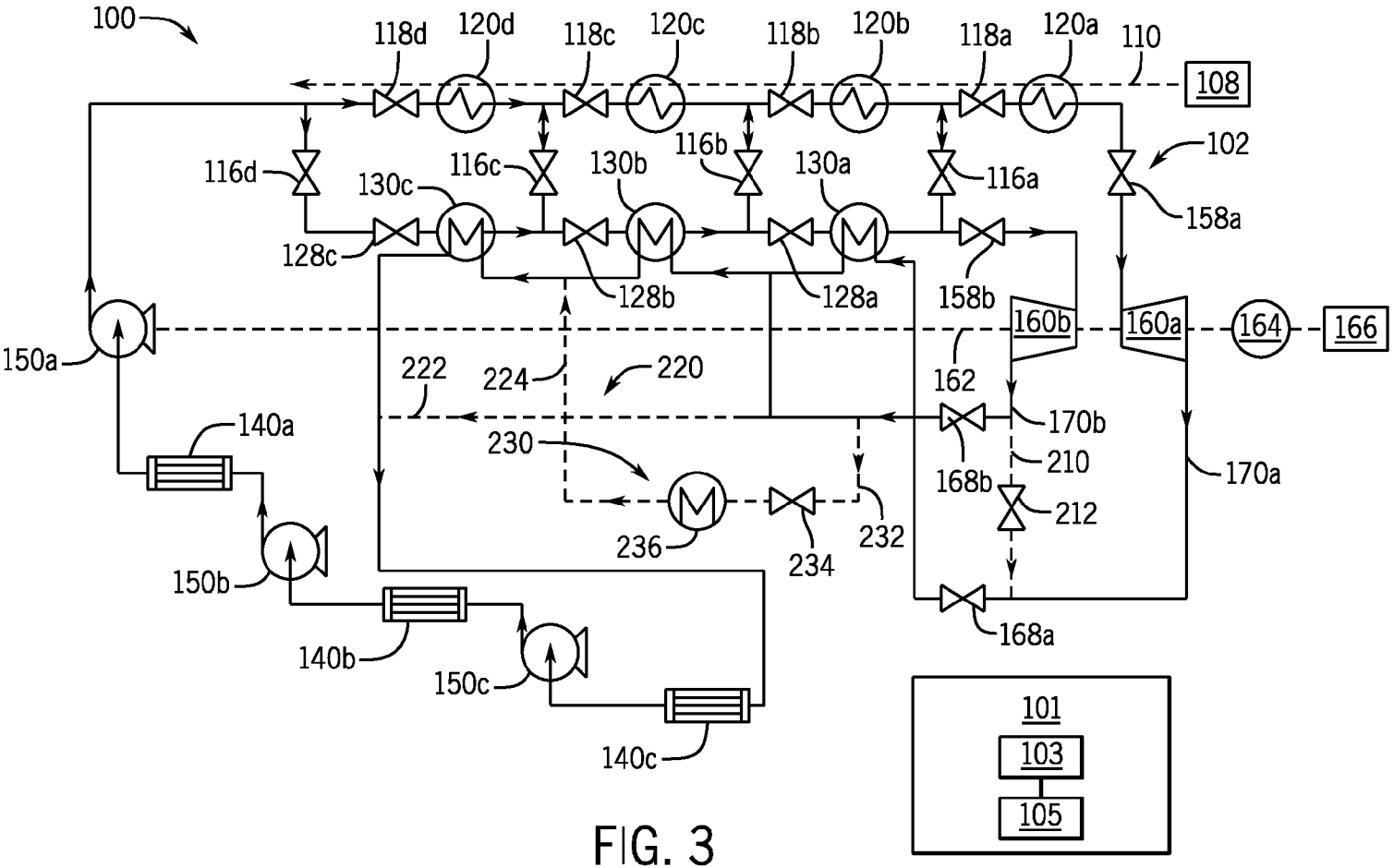
FIG. 3 illustrates a heat engine system having a process heating system, according to one or more embodiments disclosed herein.

In one or more embodiments described herein, as depicted in FIGS. 2 and 3, the tunability of the working fluid circuit 102 may be further increased by providing an additional waste heat exchanger 130*c*, an additional bypass valve 116*d*, a plurality of condensers 140*a*, 140*b*, and 140*c*, and a plurality of pumps 150*a*, 150*b*, and 150*c*. Additionally, in this embodiment, each of the first and second expanders 160*a*, 160*b* may be fluidly coupled to or isolated from the working fluid circuit 102 via the stop or throttle valves 158*a* and 158*b*, disposed between the high pressure side and the low pressure side, and configured to convert a pressure drop in the working fluid to mechanical energy. It should be noted that presently contemplated embodiments may include any number of waste heat exchangers, any number of recuperators, any number of valves, any number of pumps, any number of condensers, and any number of expanders, not limited to those shown in FIGS. 1-3. Indeed, the quantity of such components in the illustrated embodiments is merely an example, and any suitable quantity of these components may be provided in other embodiments.

In one embodiment, the plurality of waste heat exchangers 120*a*-120*d* may contain four or more waste heat exchangers, such as the first waste heat exchanger 120*a*, the second waste heat exchanger 120*b*, the third waste heat exchanger 120*c*, and a fourth waste heat exchanger 120*d*. Each of the waste heat exchangers 120*a*-120*d* may be selectively fluidly coupled to and placed in thermal communication with the high pressure side of the working fluid circuit 102, as determined by the control system 101, to tune the working fluid circuit 102 to the needs of a given application. Each of the waste heat exchangers 120*a*-120*d* may be configured to be fluidly coupled to and in thermal communication with a heat source stream 110 and configured to transfer thermal energy from the heat source stream 110 to the working fluid within the high pressure side. The waste heat exchangers 120*a*-120*d* may be disposed in series along the direction of flow of the heat source stream 110. In one configuration, with respect to the flow of the working fluid through the working fluid circuit 102, the second waste heat exchanger 120*b* may be disposed upstream of the first waste heat exchanger 120*a*, the third waste heat exchanger 120*c* may be disposed upstream of the second waste heat exchanger 120*b*, and the fourth waste heat exchanger 120*d* may be disposed upstream of the third waste heat exchanger 120*c*.

In some embodiments, the plurality of recuperators 130*a*-130*c* may include three or more recuperators, such as the first recuperator 130*a*, the second recuperator 130*b*, and a third recuperator 130*c*. Each of the recuperators 130*a*-130*c* may be selectively fluidly coupled to the working fluid circuit 102 and configured to transfer thermal energy between the high pressure side and the low pressure side of the working fluid circuit 102 when fluidly coupled to the working fluid circuit 102. In one embodiment, the recuperators 130*a*-130*c* may be disposed in series on the high pressure side of the working fluid circuit 102 upstream of the second expander 160*b*. The second recuperator 130*b* may be disposed upstream of the first recuperator 130*a*, and the third recuperator 130*c* may be disposed upstream of the second recuperator 130*b* on the high pressure side.

In one embodiment, the first recuperator 130*a*, the second recuperator 130*b*, and the third recuperator 130*c* may be disposed in series on the low pressure side of the working fluid circuit 102, such that the second recuperator 130*b* may be disposed downstream of the first recuperator 130*a*, and the third recuperator 130*c* may be disposed downstream of the second recuperator 130*b* on the low pressure side. The first recuperator 130*a* may be disposed downstream of the first expander 160*a* on the low pressure side, and the second recuperator 130*b* may be disposed downstream of the second expander 160*b* on the low pressure side.

The heat source stream 110 may be a waste heat stream such as, but not limited to, a gas turbine exhaust stream, an industrial process exhaust stream, or other types of combustion product exhaust streams, such as furnace or boiler exhaust streams, coming from or derived from a heat source 108. In some exemplary embodiments, the heat source 108 may be a gas turbine, such as a gas turbine power/electricity generator or a gas turbine jet engine, and the heat source stream 110 may be the exhaust stream from the gas turbine. The heat source stream 110 may be at a temperature within a range from about 100° C. to about 1,000° C., or greater than 1,000° C., and in some examples, within a range from about 200° C. to about 800° C., more narrowly within a range from about 300° C. to about 600° C. The heat source stream 110 may contain air, carbon dioxide, carbon monoxide, water or steam, nitrogen, oxygen, argon, derivatives thereof, or mixtures thereof. In some embodiments, the heat source stream 110 may derive thermal energy from renewable sources of thermal energy, such as solar or geothermal sources.

The heat engine system 100 also includes at least one condenser 140*a* and at least one pump 150*a*, but in some embodiments includes a plurality of condensers 140*a*-140*c* and a plurality of pumps 150*a*-150*c*. A first condenser 140*a* may be in thermal communication with the working fluid on the low pressure side of the working fluid circuit 102 and configured to remove thermal energy from the working fluid on the low pressure side. A first pump 150*a* may be fluidly coupled to the working fluid circuit 102 between the low pressure side and the high pressure side of the working fluid circuit 102 and configured to circulate or pressurize the working fluid within the working fluid circuit 102. The first pump 150*a* may be configured to control mass flowrate, pressure, or temperature of the working fluid within the working fluid circuit 102.

In other embodiments, the second condenser 140*b* and the third condenser 140*c* may each independently be fluidly coupled to and in thermal communication with the working fluid on the low pressure side of the working fluid circuit 102 and configured to remove thermal energy from the working fluid on the low pressure side of the working fluid circuit 102. Also, a second pump 150*b* and a third pump 150*c* may each independently be fluidly coupled to the low pressure side of the working fluid circuit 102 and configured to circulate or pressurize the working fluid within the working fluid circuit 102. The second pump 150*b* may be disposed upstream of the first pump 150*a* and downstream of the third pump 150*c* along the flow direction of working fluid through the working fluid circuit 102. In one exemplary embodiment, the first pump 150*a* is a circulation pump, the second pump 150*b* is replaced with a compressor, and the third pump 150*c* is replaced with a compressor.

In some examples, the third pump 150*c* is replaced with a first stage compressor, the second pump 150*b* is replaced with a second stage compressor, and the first pump 150*a* is a third stage pump. The second condenser 140*b* may be disposed upstream of the first condenser 140*a* and downstream of the third condenser 140*c* along the flow direction of working fluid through the working fluid circuit 102. In another embodiment, the heat engine system 100 includes three stages of pumps and condensers, such as first, second, and third pump/condenser stages. The first pump/condenser stage may include the third condenser 140*c* fluidly coupled to the working fluid circuit 102 upstream of the third pump 150*c*, the second pump/condenser stage may include the second condenser 140*b* fluidly coupled to the working fluid circuit 102 upstream of the second pump 150*b*, and the third pump/condenser stage may include the first condenser 140*a* fluidly coupled to the working fluid circuit 102 upstream of the first pump 150*a*.

In some examples, the heat engine system 100 may include a variable frequency drive coupled to the first pump 150*a*, the second pump 150*b*, and/or the third pump 150*c*. The variable frequency drive may be configured to control mass flowrate, pressure, or temperature of the working fluid within the working fluid circuit 102. In other examples, the heat engine system 100 may include a drive turbine coupled to the first pump 150*a*, the second pump 150*b*, or the third pump 150*c*. The drive turbine may be configured to control mass flowrate, pressure, or temperature of the working fluid within the working fluid circuit 102. The drive turbine may be the first expander 160*a*, the second expander 160*b*, another expander or turbine, or combinations thereof.

In another embodiment, the driveshaft 162 may be coupled to the first expander 160*a* and the second expander 160*b* such that the driveshaft 162 may be configured to drive a device with the mechanical energy produced or otherwise generated by the combination of the first expander 160*a* and the second expander 160*b*. In some embodiments, the device may be the pumps 150*a*-150*c*, a compressor, a generator 164, an alternator, or combinations thereof. In one embodiment, the heat engine system 100 may include the generator 164 or an alternator coupled to the first expander 160*a* by the driveshaft 162. The generator 164 or the alternator may be configured to convert the mechanical energy produced by the first expander 160*a* into electrical energy. In another embodiment, the driveshaft 162 may be coupled to the second expander 160*b* and the first pump 150*a*, such that the second expander 160*b* may be configured to drive the first pump 150*a* with the mechanical energy produced by the second expander 160*b*.

In another embodiment, as depicted in FIG. 3, the heat engine system 100 may include a process heating system 230 fluidly coupled to and in thermal communication with the low pressure side of the working fluid circuit 102. The process heating system 230 may include a process heat exchanger 236 and a control valve 234 operatively disposed on a fluid line 232 coupled to the low pressure side and under control of the control system 101. The process heat exchanger 236 may be configured to transfer thermal energy from the working fluid on the low pressure side of the working fluid circuit 102 to a heat-transfer fluid flowing through the process heat exchanger 236. In some examples, the process heat exchanger 236 may be configured to transfer thermal energy from the working fluid on the low pressure side of the working fluid circuit 102 to methane during a preheating step to form a heated methane fluid. The thermal energy may be directly transferred or indirectly transferred (e.g., via a heat-transfer fluid) to the methane fluid. The heat source stream 110 may be derived from the heat source 108 configured to combust the heated methane fluid, such as a gas turbine electricity generator.

In another embodiment, as depicted in FIG. 3, the heat engine system 100 may include a recuperator bus system 220 fluidly coupled to and in thermal communication with the low pressure side of the working fluid circuit 102. The recuperator bus system 220 may include turbine discharge lines 170*a*, 170*b*, control valves 168*a*, 168*b*, bypass line 210 and bypass valve 212, fluid lines 222, 224, and other lines and valves fluidly coupled to the working fluid circuit 102 downstream of the first expander 160*a* and/or the second expander 160*b* and upstream of the condenser 140*a*. Generally, the recuperator bus system 220 extends from the first expander 160*a* and/or the second expander 160*b* to the plurality of recuperators 130*a*-130*c*, and further downstream on the low pressure side. In one example, one end of a fluid line 222 may be fluidly coupled to the turbine discharge line 170*b*, and the other end of the fluid line 222 may be fluidly coupled to a point on the working fluid circuit 102 disposed downstream of the recuperator 130*c* and upstream of the condenser 140*c*. In another example, one end of a fluid line 224 may be fluidly coupled to the turbine discharge line 170*b*, the fluid line 222, or the process heating line 232, and the other end of the fluid line 224 may be fluidly coupled to a point on the working fluid circuit 102 disposed downstream of the recuperator 130*b* and upstream of the recuperator 130*c* on the low pressure side.

In some embodiments, the types of working fluid that may be circulated, flowed, or otherwise utilized in the working fluid circuit 102 of the heat engine system 100 include carbon oxides, hydrocarbons, alcohols, ketones, halogenated hydrocarbons, ammonia, amines, aqueous, or combinations thereof. Exemplary working fluids that may be utilized in the heat engine system 100 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid circulated, flowed, or otherwise utilized in the working fluid circuit 102 of the heat engine system 100, and the other exemplary circuits disclosed herein, may be or may contain carbon dioxide ($CO_2$) and mixtures containing carbon dioxide. Generally, at least a portion of the working fluid circuit 102 contains the working fluid in a supercritical state (e.g., sc-$CO_2$). Carbon dioxide utilized as the working fluid or contained in the working fluid for power generation cycles has many advantages over other compounds typically used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense" meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 102 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of carbon dioxide (e.g., sub-$CO_2$ or sc-$CO_2$) and one or more other miscible fluids or chemical compounds. In yet other exemplary embodiments, the working fluid may be a combination of carbon dioxide and propane, or carbon dioxide and ammonia, without departing from the scope of the disclosure.

The working fluid circuit 102 generally has a high pressure side and a low pressure side and contains a working fluid circulated within the working fluid circuit 102. The use of the term "working fluid" is not intended to limit the state or phase of matter of the working fluid. For instance, the working fluid or portions of the working fluid may be in a liquid phase, a gas phase, a fluid phase, a subcritical state, a supercritical state, or any other phase or state at any one or more points within the heat engine system 100 or thermodynamic cycle. In one or more embodiments, such as during a startup process, the working fluid is in a supercritical state over certain portions of the working fluid circuit 102 of the heat engine system 100 (e.g., a high pressure side) and in a subcritical state over other portions of the working fluid circuit 102 of the heat engine system 100 (e.g., a low pressure side). In other embodiments, the entire thermodynamic cycle may be operated such that the working fluid is maintained in a supercritical state throughout the entire working fluid circuit 102 of the heat engine system 100.

In embodiments disclosed herein, broadly, the high pressure side of the working fluid circuit 102 may be disposed downstream of any of the pumps 150*a*, 150*b*, or 150*c* and upstream of any of the expanders 160*a* or 160*b*, and the low pressure side of the working fluid circuit 102 may be disposed downstream of any of the expanders 160*a* or 160*b* and upstream of any of the pumps 150*a*, 150*b*, or 150*c*, depending on implementation-specific considerations, such as the type of heat source available, process conditions, including temperature, pressure, flowrate, and whether or not each individual pump 150*a*, 150*b*, or 150*c* is a pump or a compressor, and so forth. In one exemplary embodiment, the pumps 150*b* and 150*c* are replaced with compressors and the pump 150*a* is a pump, and the high pressure side of the working fluid circuit 102 may start downstream of the pump 150*a*, such as at the discharge outlet of the pump 150*a*, and end at any of the expanders 160*a* or 160*b*, and the low pressure side of the working fluid circuit 102 may start downstream of any of the expanders 160*a* or 160*b* and end upstream of the pump 150*a*, such as at the inlet of the pump 150*a*.

Generally, the high pressure side of the working fluid circuit 102 contains the working fluid (e.g., sc-$CO_2$) at a pressure of about 15 MPa or greater, such as about 17 MPa or greater or about 20 MPa or greater, or about 25 MPa or greater, or about 27 MPa or greater. In some examples, the high pressure side of the working fluid circuit 102 may have a pressure within a range from about 15 MPa to about 40 MPa, more narrowly within a range from about 20 MPa to about 35 MPa, and more narrowly within a range from about 25 MPa to about 30 MPa, such as about 27 MPa.

The low pressure side of the working fluid circuit 102 includes the working fluid (e.g., $CO_2$ or sub-$CO_2$) at a pressure of less than 15 MPa, such as about 12 MPa or less, or about 10 MPa or less. In some examples, the low pressure side of the working fluid circuit 102 may have a pressure within a range from about 1 MPa to about 10 MPa, more narrowly within a range from about 2 MPa to about 8 MPa, and more narrowly within a range from about 4 MPa to about 6 MPa, such as about 5 MPa.

The heat engine system 100 further includes the expander 160*a*, the expander 160*b*, and the driveshaft 162. Each of the expanders 160*a*, 160*b* may be fluidly coupled to the working fluid circuit 102 and disposed between the high and low pressure sides and configured to convert a pressure drop in the working fluid to mechanical energy. The driveshaft 162 may be coupled to the expander 160*a*, the expander 160*b*, or both of the expanders 160*a*, 160*b*. The driveshaft 162 may be configured to drive one or more devices, such as a generator or alternator (e.g., the generator 164), a motor, a generator/motor unit, a pump or compressor (e.g., the pumps 150*a*-150*c*), and/or other devices, with the generated mechanical energy.

The generator 164 may be a generator, an alternator (e.g., permanent magnet alternator), or another device for generating electrical energy, such as by transforming mechanical energy from the driveshaft 162 and one or more of the expanders 160*a*, 160*b* to electrical energy. A power outlet (not shown) may be electrically coupled to the generator 164 and configured to transfer the generated electrical energy from the generator 164 to an electrical grid 166. The electrical grid 166 may be or include an electrical grid, an electrical bus (e.g., plant bus), power electronics, other electric circuits, or combinations thereof. The electrical grid 166 generally contains at least one alternating current bus, alternating current grid, alternating current circuit, or combinations thereof. In one example, the generator 164 is a generator and is electrically and operably connected to the electrical grid 166 via the power outlet. In another example, the generator 164 is an alternator and is electrically and operably connected to power electronics (not shown) via the power outlet. In another example, the generator 164 is electrically connected to power electronics that are electrically connected to the power outlet.

The heat engine system 100 further includes at least one pump/compressor and at least one condenser/cooler, but certain embodiments generally include a plurality of condensers 140*a*-140*c* (e.g., condenser or cooler) and pumps 150*a*-150*c* (e.g., pump or compressor). Each of the condensers 140*a*-140*c* may independently be a condenser or a cooler and may independently be gas-cooled (e.g., air, nitrogen, or carbon dioxide) or liquid-cooled (e.g., water, solvent, or a mixture thereof). Each of the pumps 150*a*-150*c* may independently be a pump or may be replaced with a compressor and may independently be fluidly coupled to the working fluid circuit 102 between the low pressure side and the high pressure side of the working fluid circuit 102. Also, each of the pumps 150*a*-150*c* may be configured to circulate and/or pressurize the working fluid within the working fluid circuit 102. The condensers 140*a*-140*c* may be in thermal communication with the working fluid in the working fluid circuit 102 and configured to remove thermal energy from the working fluid on the low pressure side of the working fluid circuit 102.

After exiting the pump 150*a*, the working fluid may flow through the waste heat exchangers 120*a*-120*d* and/or the recuperators 130*a*-130*c* before entering the expander 160*a* and/or the expander 160*b*. A series of valves and lines (e.g., conduits or pipes) that include the bypass valves 116*a*-116*d*, the stop or control valves 118*a*-118*d*, the stop or control valves 128*a*-128*c*, and the stop or throttle valves 158*a*, 158*b* may be utilized in varying opened positions and closed positions to control the flow of the working fluid through the waste heat exchangers 120*a*-120*d* and/or the recuperators 130*a*-130*c*. Therefore, such valves may provide control and adjustability to the temperature of the working fluid entering the expander 160*a* and/or the expander 160*b*. The valves may be controllable, fixed (orifice), diverter valve, 3-way valve, or even eliminated in some embodiments. Similarly, each of the additional components (e.g., additional waste heat exchangers and recuperators may be used or eliminated in certain embodiments). For example, recuperator 130*b* may not be utilized in certain applications.

The common shaft or driveshaft 162 may be employed or, in other embodiments, two or more shafts may be used together or independently with the pumps 150*a*-150*c*, the expanders 160*a*, 160*b*, the generator 164, and/or other components. In one example, the expander 160*b* and the pump 150*a* share a common shaft, and the expander 160*a* and the generator 164 share another common shaft. In another example, the expanders 160*a*, 160*b*, the pump 150*a*, and the generator 164 share a common shaft, such as driveshaft 162. The other pumps may be integrated with the shaft as well. In another embodiment, the process heating system 230 may be a loop to provide thermal energy to heat source fuel, for example, a gas turbine with preheat fuel (e.g., methane), process steam, or other fluids.

Figure 4A:
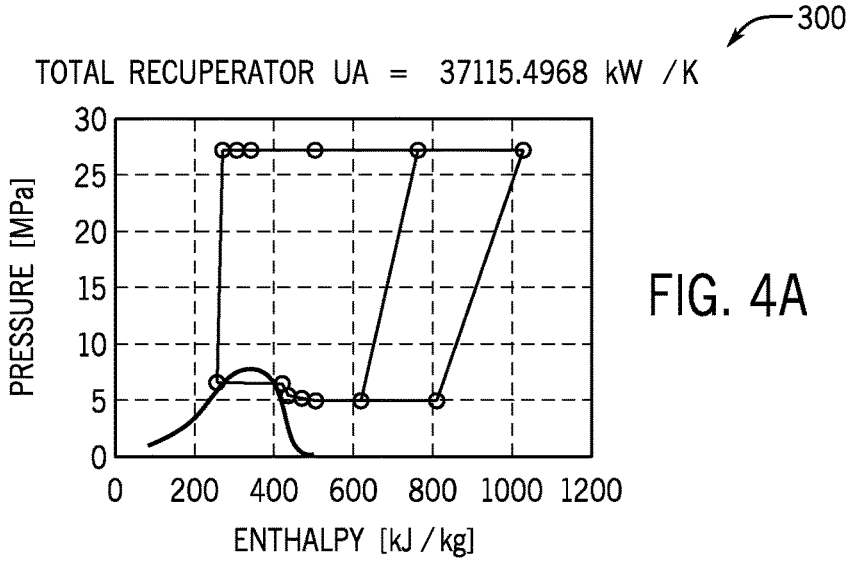
FIG. 4A is a pressure versus enthalpy chart for a thermodynamic cycle produced by an embodiment of a heat engine system.
Figure 4B:
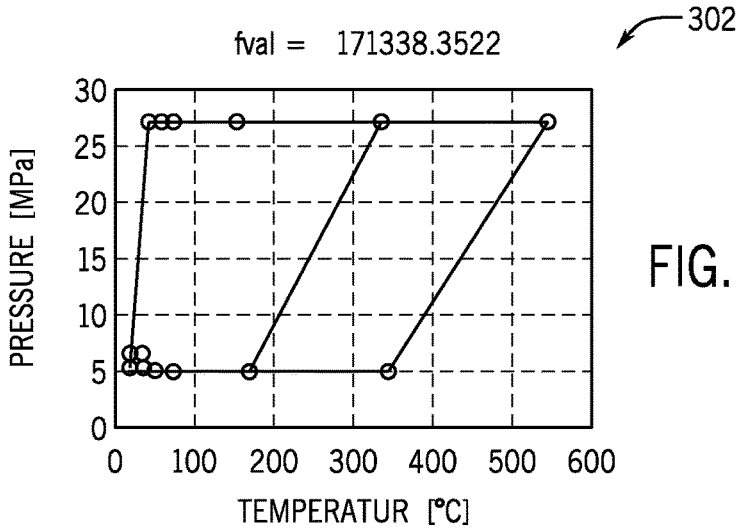
FIG. 4B is a pressure versus temperature chart for a thermodynamic cycle produced by an embodiment of a heat engine system.
Figure 4C:
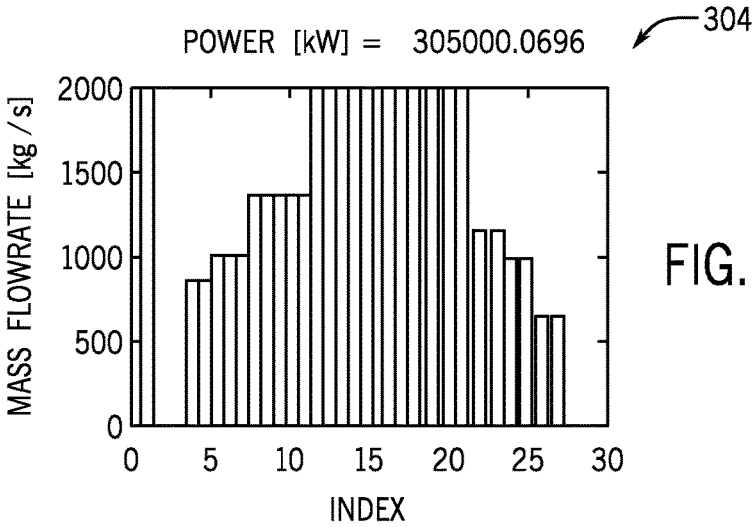
FIG. 4C is a mass flowrate bar chart for a thermodynamic cycle produced by an embodiment of a heat engine system.
Figure 4D:
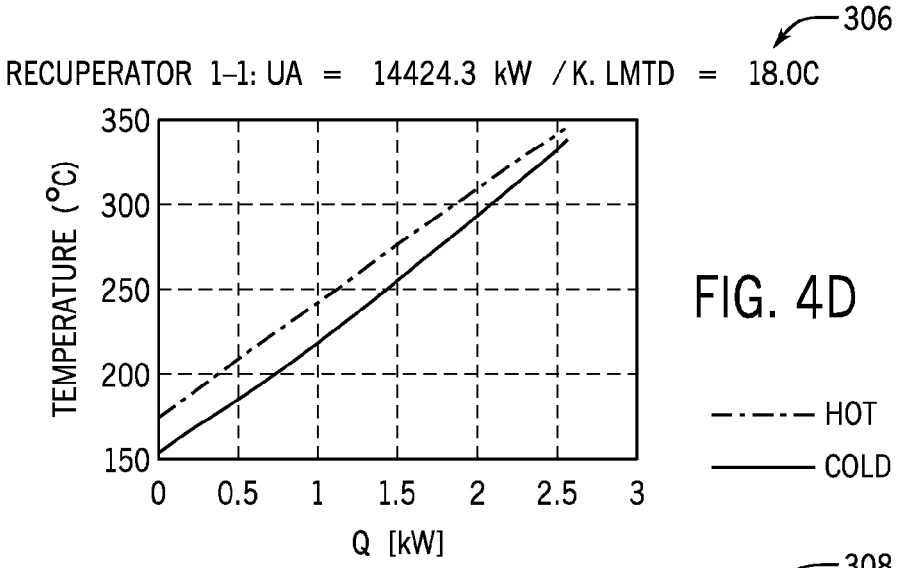
FIG. 4D is a temperature trace chart for a recuperator for a thermodynamic cycle produced by an embodiment of a heat engine system.
Figure 4E:
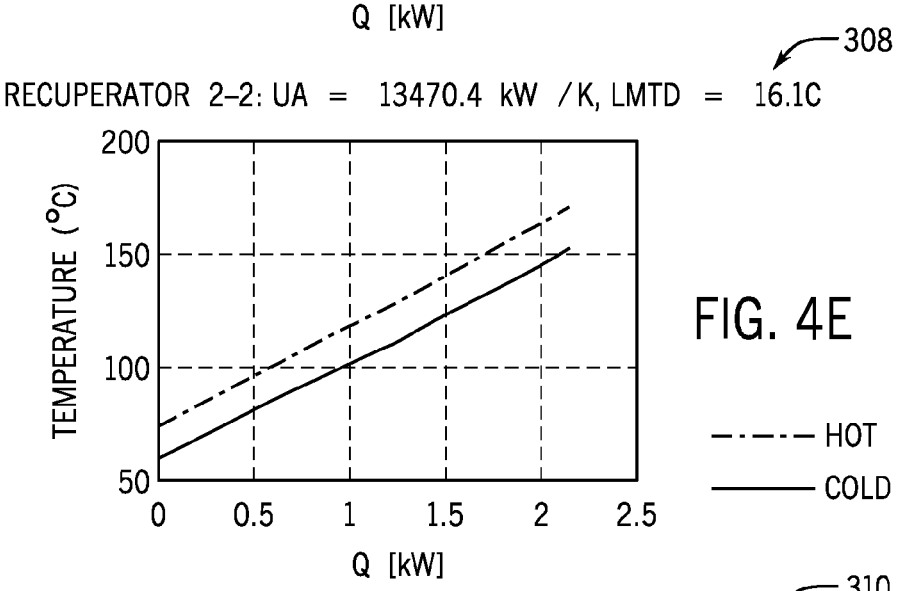
FIG. 4E is a temperature trace chart for a recuperator for a thermodynamic cycle produced by an embodiment of a heat engine system.
Figure 4F:
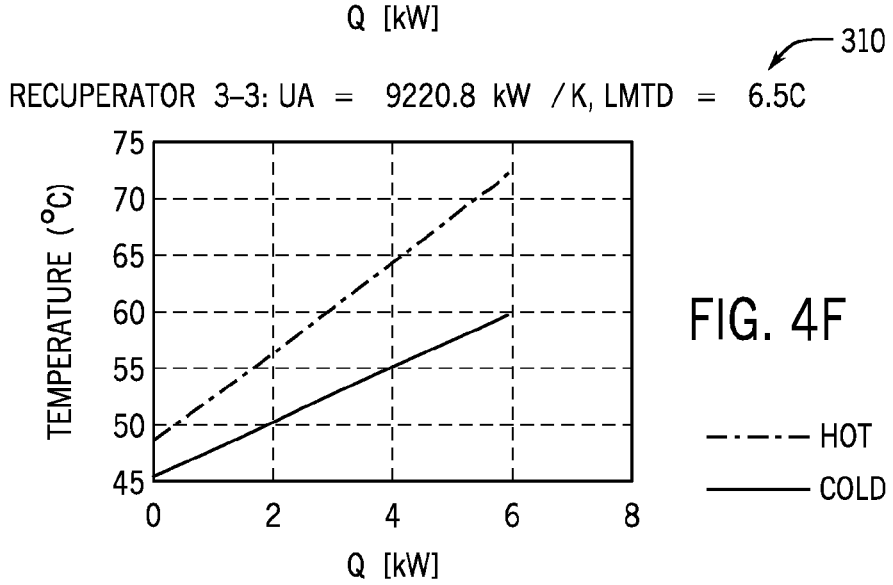
FIG. 4F is a temperature trace chart for a recuperator for a thermodynamic cycle produced by an embodiment of a heat engine system.
Figure 4G:
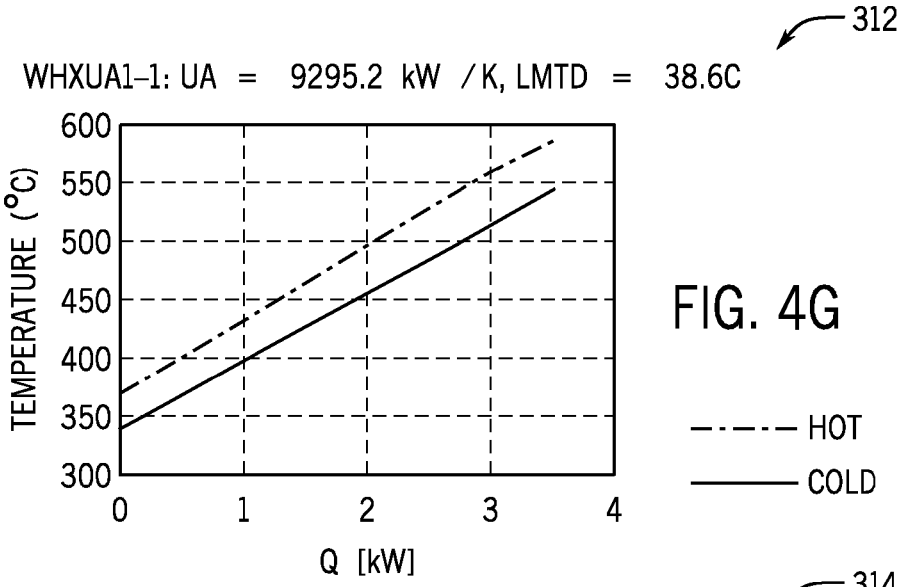
FIG. 4G is a temperature trace chart for a waste heat exchanger for a thermodynamic cycle produced by an embodiment of a heat engine system.
Figure 4H:
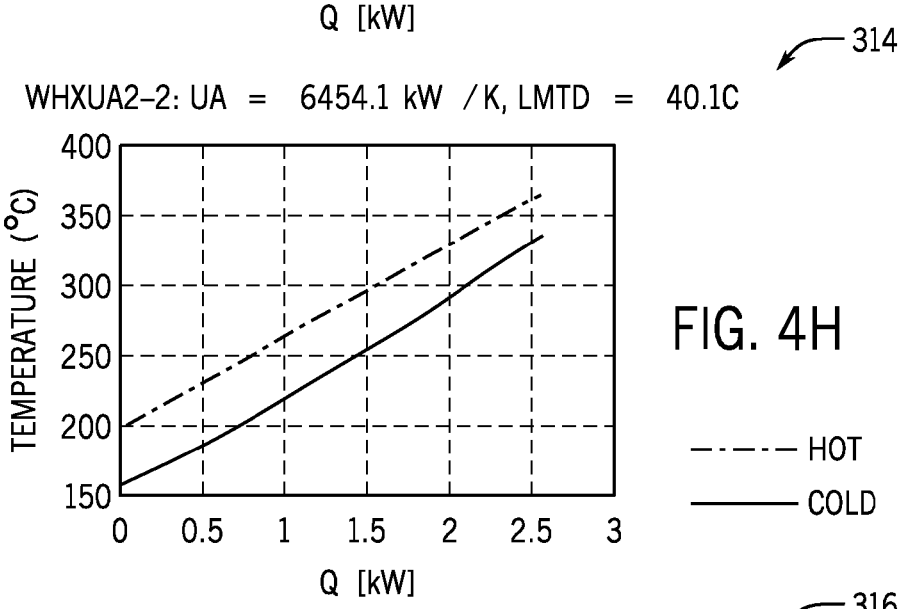
FIG. 4H is a temperature trace chart for a waste heat exchanger for a thermodynamic cycle produced by an embodiment of a heat engine system.
Figure 4I:
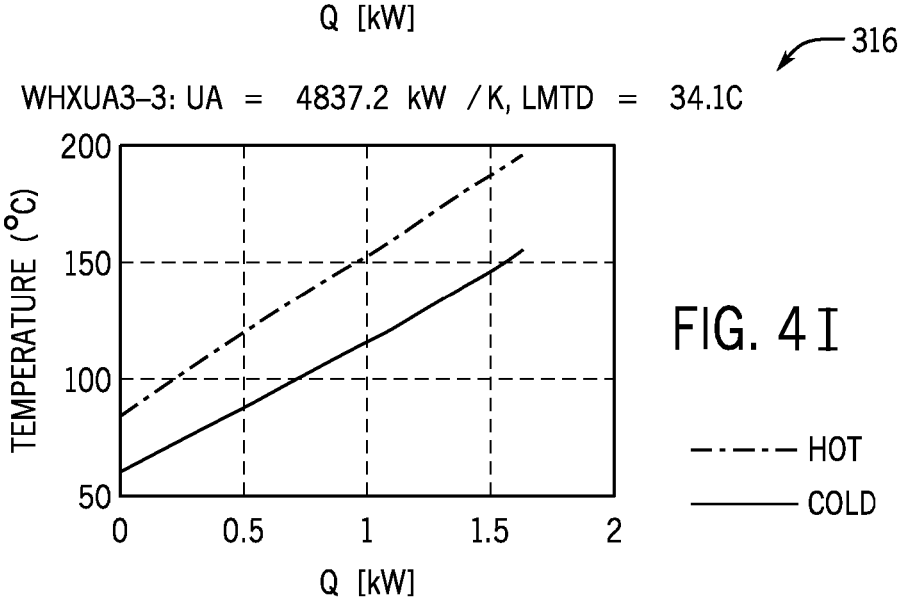
FIG. 4I is a temperature trace chart for a waste heat exchanger for a thermodynamic cycle produced by an embodiment of a heat engine system.
Figure 4J:
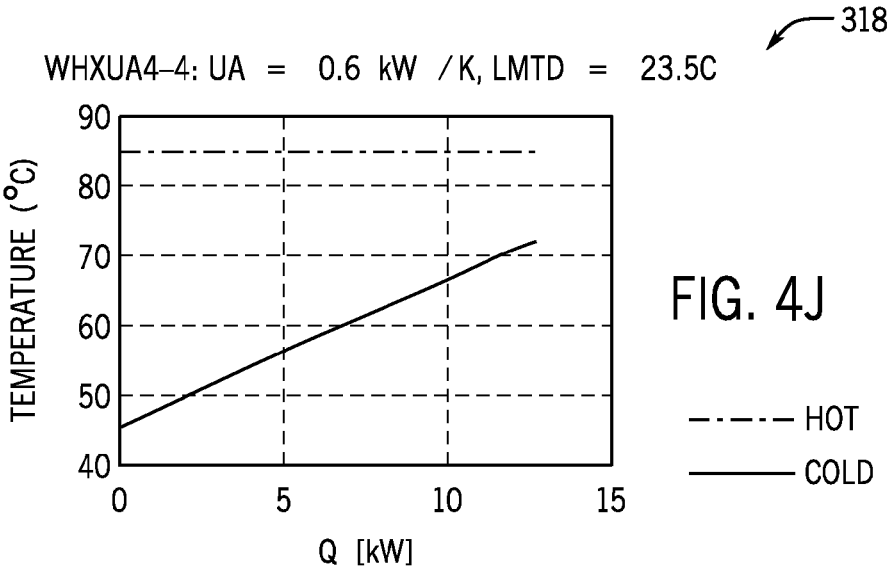
FIG. 4J is a temperature trace chart for a waste heat exchanger for a thermodynamic cycle produced by an embodiment of a heat engine system.

FIGS. 4A-4J and 5 illustrate pressure versus enthalpy charts, temperature trace charts, and recuperator temperature trace charts for thermodynamic cycles produced by the heat engine system 100 depicted in FIGS. 1-3, according to one or more embodiments disclosed herein. More specifically, FIG. 4A is a pressure versus enthalpy chart 300 for a thermodynamic cycle produced by the heat engine system 100, FIG. 4B is a pressure versus temperature chart 302 for the thermodynamic cycle, and FIG. 4C is a mass flowrate bar chart 304 for the thermodynamic cycle. FIG. 4D, FIG. 4E, and FIG. 4F are temperature trace charts 306, 308, and 310 for the recuperator 130*a*, the recuperator 130*b*, and the recuperator 130*c*, respectively, for the thermodynamic cycle produced by the heat engine system 100. FIG. 4G, FIG. 4H, FIG. 4I, and FIG. 4J are temperature trace charts 312, 314, 316, and 318 for the waste heat exchanger 120*a*, the waste heat exchanger 120*b*, the waste heat exchanger 120*c*, and the waste heat exchanger 120*d*, respectively, for the thermodynamic cycle.

Figure 5:
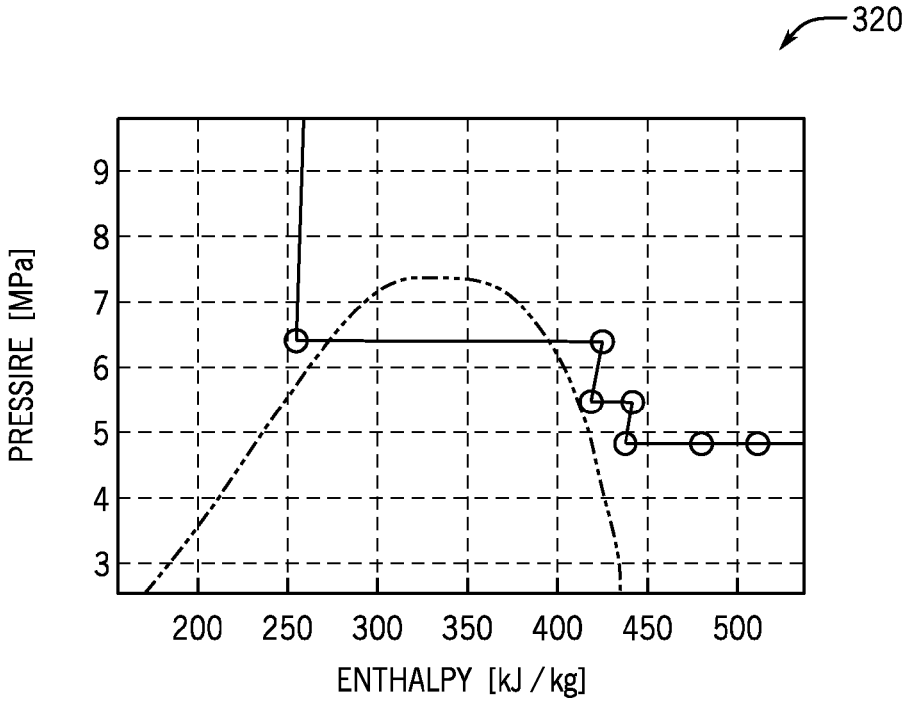
FIG. 5 is an enlarged view of a portion of the pressure versus enthalpy chart shown in FIG. 4A.

FIG. 5 is an enlarged view of a portion 320 of the pressure versus enthalpy chart 300 shown in FIG. 4A. The pressure versus enthalpy chart illustrates labeled state points for the thermodynamic cycle of the heat engine system 100. In one embodiment, the described thermodynamic power cycles may include greater use of recuperation as ambient temperature increases, minimizing the use of costly waste heat exchangers and increasing the net system output power for some ambient conditions.

It is to be understood that the present disclosure describes several exemplary embodiments for implementing different features, structures, or functions of the disclosure. Exemplary embodiments of components, arrangements, and configurations are described herein to simplify the present disclosure, however, these exemplary embodiments are provided merely as examples and are not intended to limit the scope of the disclosure. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, i.e., any element from one exemplary embodiment may be used in any other exemplary embodiment without departing from the scope of the disclosure.

Additionally, certain terms are used throughout the written description and claims to refer to particular components. As one skilled in the art will appreciate, various entities may refer to the same component by different names, and as such, the naming convention for the elements described herein is not intended to limit the scope of the disclosure, unless otherwise specifically defined herein. Further, the naming convention used herein is not intended to distinguish between components that differ in name but not function. Further, in the written description and in the claims, the terms "including", "containing", and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B", unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A heat engine system, comprising:

a working fluid circuit having a high pressure side and a low pressure side and being configured to flow a working fluid therethrough;

a plurality of waste heat exchangers, wherein each of the waste heat exchangers is configured to be fluidly coupled to and in thermal communication with a heat source stream, to transfer thermal energy from the heat source stream to the working fluid within the high pressure side, and to be selectively positioned in the high pressure side;

a plurality of recuperators, wherein each of the recuperators is configured to transfer thermal energy between the high pressure side and the low pressure side of the working fluid circuit and to be selectively positioned in the high pressure side and the low pressure side;

a first expander fluidly coupled to the working fluid circuit, disposed between the high pressure side and the low pressure side, and configured to convert a pressure drop in the working fluid to mechanical energy;

a second expander fluidly coupled to the working fluid circuit, disposed between the high pressure side and the low pressure side, and configured to convert the pressure drop in the working fluid to mechanical energy;

a first pump fluidly coupled to the working fluid circuit between the low pressure side and the high pressure side of the working fluid circuit and configured to circulate or pressurize the working fluid within the working fluid circuit;

a first condenser configured to be in thermal communication with the working fluid on the low pressure side of the working fluid circuit and configured to remove thermal energy from the working fluid on the low pressure side of the working fluid circuit; and a plurality of valves, each configured to be actuated to the opened position, the closed position, or the partially opened position to enable selective control over whether one or more of the plurality of waste heat exchangers are positioned in the high pressure side and to enable selective control over whether one or more of the plurality of recuperators are positioned in the high pressure side and the low pressure side.

2. The heat engine system of claim 1, further comprising a generator coupled to the first expander by a driveshaft, wherein the generator or the alternator is configured to convert the mechanical energy into electrical energy.

3. The heat engine system of claim 1, further comprising a driveshaft coupled to the first expander and the second expander, wherein the driveshaft is configured to drive the first pump, a compressor, a generator, an alternator, or a combination thereof with the mechanical energy.

4. The heat engine system of claim 1, further comprising:

a second pump fluidly coupled to the working fluid circuit and configured to circulate or pressurize the working fluid within the working fluid circuit;

a second condenser in thermal communication with the working fluid in the working fluid circuit and configured to remove thermal energy from the working fluid in the working fluid circuit;

a third pump fluidly coupled to the working fluid circuit and configured to circulate or pressurize the working fluid within the working fluid circuit; and a third condenser in thermal communication with the working fluid in the working fluid circuit and configured to remove thermal energy from the working fluid in the working fluid circuit.

5. The heat engine system of claim 1, further comprising a process heating system fluidly coupled to and in thermal communication with the low pressure side of the working fluid circuit.

6. The heat engine system of claim 5, wherein the process heating system comprises a process heat exchanger configured to transfer thermal energy from the working fluid on the low pressure side of the working fluid circuit to a heat-transfer fluid flowing through the process heat exchanger.

7. The heat engine system of claim 6, wherein the process heat exchanger is configured to transfer thermal energy from the working fluid on the low pressure side of the working fluid circuit to a fluid comprising methane during a preheating step to form a heated methane fluid, and the heat source stream is derived from a heat source configured to combust the heated methane fluid.

8. A heat engine system, comprising:

a pump configured to pressurize and circulate a working fluid through a working fluid circuit having a high pressure side and a low pressure side;

a first expander configured to receive the working fluid from the high pressure side and to convert a pressure drop in the working fluid to mechanical energy;

a plurality of waste heat exchangers disposed in series along a flow path of a heat source stream and each configured to transfer thermal energy from the heat source stream to the working fluid and to be selectively positioned in the high pressure side;

a plurality of recuperators, each configured to transfer thermal energy from the working fluid flowing through the low pressure side to the working fluid flowing through the high pressure side and to be selectively positioned in the high pressure side and the low pressure side; and a plurality of valves, each configured to be actuated to the opened position, the closed position, or the partially opened position to enable selective control over whether one or more of the plurality of waste heat exchangers are positioned in the high pressure side, and to enable selective control over whether one or more of the plurality of recuperators are positioned in the high pressure side and the low pressure side.

9. The heat engine system of claim 8, further comprising a second expander configured to receive the working fluid from the high pressure side and to convert the pressure drop in the working fluid to mechanical energy.

10. The heat engine system of claim 9, further comprising a stop valve configured to be positioned in an open position to fluidly couple the second expander to the high pressure side or in a closed position to fluidly isolate the second expander from the high pressure side.

11. The heat engine system of claim 9, wherein the low pressure side comprises a working fluid flow path from the second expander, through the plurality of recuperators, through a condenser, and to the pump.

12. The heat engine system of claim 8, wherein the low pressure side comprises a working fluid flow path from the first expander, through one of the plurality of recuperators, through a condenser, and to the pump.

13. The heat engine system of claim 8, further comprising a pump bypass valve fluidly coupled to the low pressure side and configured to enable transfer of the working fluid from the low pressure side to the high pressure side.

14. The heat engine system of claim 8, further comprising a recuperator bus system fluidly coupled to and in thermal communication with the low pressure side of the working fluid circuit.

15. The heat engine system of claim 14, wherein the recuperator bus system comprises fluid lines and valves that are fluidly coupled to the working fluid circuit downstream of the first expander and fluidly coupled to the plurality of recuperators.

16. A heat engine system, comprising:

a working fluid circuit having a high pressure side and a low pressure side and being configured to flow a working fluid therethrough;

a first expander configured to receive the working fluid from the high pressure side and to convert a pressure drop in the working fluid to mechanical energy;

a second expander configured to receive the working fluid from the high pressure side and to convert the pressure drop in the working fluid to mechanical energy;

a plurality of waste heat exchangers disposed in series along a flow path of a heat source stream and each configured to transfer thermal energy from the heat source stream to the working fluid and to be selectively positioned in the high pressure side;

a plurality of recuperators, each configured to transfer thermal energy from the working fluid flowing through the low pressure side to the working fluid flowing through the high pressure side and to be selectively positioned in the high pressure side and the low pressure side; and a plurality of valves, each configured to be actuated to the opened position, the closed position, or the partially opened position to enable selective control over whether one or more of the plurality of waste heat exchangers are positioned in the high pressure side, to enable selective control over whether one or more of the plurality of recuperators are positioned in the high pressure side and the low pressure side, and to enable selective control over whether the first expander, the second expander, or both are to receive the working fluid from the high pressure side.

17. The heat engine system of claim 16, further comprising a condenser configured to be in thermal communication with the working fluid on the low pressure side of the working fluid circuit and to remove thermal energy from the working fluid on the low pressure side of the working fluid circuit.

* * * * *